US010779564B2

(12) United States Patent
Treadaway et al.

(10) Patent No.: US 10,779,564 B2
(45) Date of Patent: Sep. 22, 2020

(54) TOBACCO SMOKE FILTER

(75) Inventors: Ann R. Treadaway, Clemmons, NC (US); James D. Reed, Winston Salem, NC (US); Stephen Longley-Martines, Templeton, MA (US)

(73) Assignee: FILTRONA FILTER PRODUCTS DEVELOPMENT CO. PTE. LTD, Singapore (SG)

( * ) Notice: Subject to any disclaimer, the term of this patent is extended or adjusted under 35 U.S.C. 154(b) by 1016 days.

(21) Appl. No.: 13/509,477

(22) PCT Filed: Nov. 11, 2010

(86) PCT No.: PCT/GB2010/002084

§ 371 (c)(1),
(2), (4) Date: Jul. 31, 2012

(87) PCT Pub. No.: WO2011/058319

PCT Pub. Date: May 19, 2011

(65) Prior Publication Data

US 2012/0291792 A1 Nov. 22, 2012

Related U.S. Application Data

(60) Provisional application No. 61/260,509, filed on Nov. 12, 2009.

(30) Foreign Application Priority Data

Nov. 20, 2009 (GB) ..... 0920397.7

(51) Int. Cl.
*A24D 3/02* (2006.01)
*A24D 3/04* (2006.01)

(52) U.S. Cl.
CPC ..... *A24D 3/0225* (2013.01); *A24D 3/048* (2013.01)

(58) Field of Classification Search
CPC ..... A24D 3/0212; A24D 3/048; A24D 3/0225
USPC ..... 131/202
See application file for complete search history.

(56) References Cited

U.S. PATENT DOCUMENTS 3,101,723 A * 8/1963 Seligman et al. ..... 131/342
4,228,246 A 10/1980 Taub et al.
4,281,671 A * 8/1981 Bynre et al. ..... 131/335
4,291,711 A 9/1981 Berger
4,754,766 A * 7/1988 Luke et al. ..... 131/339
(Continued)

FOREIGN PATENT DOCUMENTS

CA 2 755 646 A1 9/2010
DE 10 2006 025 738 B3 11/2007
(Continued)

OTHER PUBLICATIONS

Great Britain Search Report issued in Application No. GB0920397.7 dated May 5, 2010 (1 page).
(Continued)

*Primary Examiner* — Michael H. Wilson
*Assistant Examiner* — Yana B Krinker
(74) *Attorney, Agent, or Firm* — Flynn Thiel, P.C.

(57) ABSTRACT

There is provided a tobacco smoke filter (1) or filter element comprising: a rod (2) of a tobacco smoke filtering material; a continuous extruded element (7) extending longitudinally of the rod (2); and a flavouring agent.

1 Claim, 2 Drawing Sheets

(56) References Cited

U.S. PATENT DOCUMENTS

Figure 1:
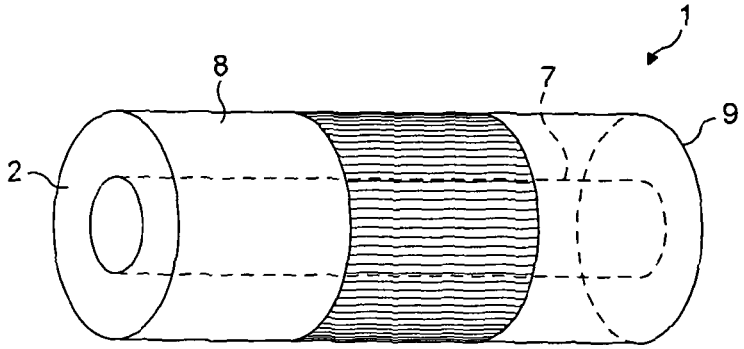

| | | | | |
|---|---|---|---|---|
| 4,971,078 | A * | 11/1990 | Deutsch | A24D 3/14 131/335 |
| 5,070,891 | A * | 12/1991 | Rutherford | A01K 55/00 131/270 |
| 5,144,966 | A * | 9/1992 | Washington | 131/335 |
| 5,387,208 | A * | 2/1995 | Ashton | A61F 13/531 604/358 |
| 5,435,326 | A * | 7/1995 | Gentry et al. | 131/344 |
| 5,509,430 | A | 4/1996 | Berger | |
| 6,631,722 | B2 | 10/2003 | MacAdam et al. | |
| 7,074,170 | B2 | 7/2006 | Lanier, Jr. et al. | |
| 7,249,605 | B2 | 7/2007 | MacAdam et al. | |
| 7,691,043 | B2 | 4/2010 | Lanier, Jr. et al. | |
| 7,740,019 | B2 | 6/2010 | Nelson et al. | |
| 7,757,698 | B2 * | 7/2010 | Evani | 131/339 |
| 2003/0029466 | A1 | 2/2003 | Oliver | |
| 2003/0098033 | A1 * | 5/2003 | MacAdam et al. | 131/344 |
| 2003/0224918 | A1 | 12/2003 | Lanier, Jr. et al. | |
| 2004/0074507 | A1 | 4/2004 | MacAdam et al. | |
| 2005/0066980 | A1 * | 3/2005 | Crooks et al. | 131/341 |
| 2005/0255978 | A1 | 11/2005 | Lanier, Jr. et al. | |
| 2007/0243500 | A1 * | 10/2007 | Stange | A61C 13/0003 433/167 |
| 2008/0029118 | A1 * | 2/2008 | Nelson | A24D 3/0225 131/365 |
| 2008/0149119 | A1 * | 6/2008 | Marquez | A24B 15/283 131/203 |
| 2008/0302373 | A1 | 12/2008 | Stokes et al. | |
| 2009/0301503 | A1 | 12/2009 | Peter et al. | |
| 2010/0152008 | A1 | 6/2010 | Lanier, Jr. et al. | |
| 2010/0192962 | A1 | 8/2010 | Nelson et al. | |
| 2010/0294288 | A1 | 11/2010 | Sampson et al. | |

FOREIGN PATENT DOCUMENTS

| | | | |
|---|---|---|---|
| DE | 10 2006 027 597 | A1 | 12/2007 |
| EP | 0 636 324 | A1 | 2/1995 |
| EP | 0 649 607 | A2 | 4/1995 |
| GB | 2 020 158 | A | 11/1979 |
| GB | 2 260 887 | A | 5/1993 |
| JP | 03-172164 | A | 7/1991 |
| JP | 07-147964 | A | 6/1995 |
| JP | 11-318418 | A | 11/1999 |
| JP | 2003-174862 | A | 6/2003 |
| RU | 2 127 986 | C1 | 3/1999 |
| WO | WO 85/00092 | A1 | 1/1985 |
| WO | WO 03/082558 | A1 | 10/2003 |
| WO | WO 2007/085830 | A2 | 8/2007 |
| WO | WO 2008/016839 | A1 | 2/2008 |
| WO | WO 2009/010380 | A2 | 1/2009 |

OTHER PUBLICATIONS

Form PCT/ISA/210 International Search Report dated Feb. 9, 2011 (6 pages).

Canadian Office Action issued in Appln. No. 2 780 241 dated May 16, 2014 (2 pages).

Japanese Office Action issued in Appln. No. 2012-538397 dated Feb. 3, 2015 with English translation (13 pages).

Russian Office Action issued in Appln. No. 2012123440/12 dated Dec. 16, 2014 with English translation (5 pages).

* cited by examiner

TOBACCO SMOKE FILTER

CROSS-REFERENCE TO RELATED APPLICATION

This application is the National Stage of International Application No. PCT/GB2010/002084, filed Nov. 11, 2010, which claims the benefit of U.S. Provisional Application No. 61/260,509, filed Nov. 12, 2009.

The present invention relates to tobacco smoke filters (e.g. for cigarettes) and their production.

'Flavour Thread' cigarette filters are well known in the prior art. Such filters incorporate a thread or tape element, typically longitudinally aligned therein, the element carrying a smoke modifying agent such as a flavourant. These were originally proposed in U.S. Pat. No. 4,281,671, in which a cotton sewing thread was the preferred element. This document also disclosed how the thread could be coloured, e.g. with different colours denoting different flavours.

In recent years, there has been a growing commercial interest in the use of flavour thread filters with coloured threads. When a coloured thread is used, there is a greater need for the thread element to be precisely located in the centre of the (white) filter fibrous matrix. Various improvements have been suggested to the process of manufacturing flavour thread filters to try and ensure such central alignment, see for examples WO 03/082558, WO 07/085,830 and WO 08/016,839.

WO 09/010,380 describes a further embodiment of flavour thread filters in which a cellulose acetate thread formed from substantially uncrimped cellulose acetate filaments is used as the central element. It is claimed that such filaments give reduced end-staining as compared to cotton threads. In addition, when pigmented cellulose acetate filaments are used, these are claimed to be more colour-fast than cotton threads, where possible leaching of dyes can occur.

One advantage of using a coloured central element is that it provides a more distinctive end appearance that is useful for anti-counterfeit purposes. However, the textile- and filamentary-based yarns that have previously been proposed suffer from the disadvantage that they are limited to small, approximately circular cross-sections. If it is desired to use a larger thread, these can flatten in profile when cut during filter-making and, due to the reflection of light from the multitudinous filaments used therein give the impression that colour is bleeding into the surrounding (white) filamentary tow.

The present inventors have found that it is advantageously possible to use an extruded element rather than a filamentary yarn or thread in flavour thread filters.

According to the present invention there is provided a tobacco smoke filter or filter element comprising: a rod (for example a substantially cylindrical rod) of a tobacco smoke filtering material; a continuous extruded element extending longitudinally of the rod (for example extending longitudinally through the rod, extending along the rod); and a flavouring agent. The flavouring agent may be, for example, present on (applied to) the extruded element. The flavouring agent may be any flavouring agent known or suitable for use in a smoking article such as a cigarette, for example menthol, spearmint etc. A preferred flavouring agent is menthol. The tobacco smoke filter may be of length between 10 and 40 mm, e.g. between 15 and 35 mm, e.g. between 20 and 30 mm. The tobacco smoke filter element may be of length between 6 and 20 mm, e.g. between 10 and 19 mm, e.g. between 14 and 18 mm. The tobacco smoke filter or filter element may be of circumference between 16 and 38 mm, for example between 16 and 28 mm, for example between 20 and 26 mm. The continuous extruded element extending longitudinally of the rod may be of diameter (for a circle) or width at narrowest point (for other shape) of about 0.05 mm or greater, for example of diameter (for a circle) or width at narrowest point (for other shape) of from around 0.5 to around 10 mm. Thus, filters and filter elements of the invention [which including such continuous extruded element(s)] may find use with superslim cigarettes (typically of about 16 mm circumference), standard cigarettes (typically of about 24 mm circumference) and cigars (typically of about 36 mm circumference). In one example, the continuous extruded element extending longitudinally of the rod may be of diameter (for a circle) or width at narrowest point (for other shape) of from around 0.5 to around 1.5 mm. In another example, the continuous extruded element extending longitudinally of the rod may be of diameter (for a circle) or width at narrowest point (for other shape) of from around 0.5 to around 10 mm; such larger continuous extruded elements may advantageously facilitate a reduction in weight or cost of the other filter components.

In an example, the continuous extruded element extending longitudinally of the rod is of hollow cross-section. Thus, in an example, the present invention provides a tobacco smoke filter or filter element comprising: a rod (for example a substantially cylindrical rod) of a tobacco smoke filtering material; a continuous extruded element extending longitudinally of the rod (for example extending longitudinally through the rod, extending along the rod); and a flavouring agent, wherein the continuous extruded element extending longitudinally of the rod is of hollow cross-section. The flavouring agent may be applied, for example, to the extruded element. The flavouring agent may be any flavouring agent known or suitable for use in a smoking article such as a cigarette, for example menthol, spearmint etc. A preferred flavouring agent is menthol. Thus, in this example, the continuous extruded element of hollow cross section may be a tubular element, for example cylindrical (i.e. a continuous extruded hollow tubular element of circular cross-section) or a continuous extruded hollow tubular element of other (non-circular) cross-section (e.g. hollow star shaped, trilobal, pentagonal or cog-shaped cross section, or of a hollow cross-section in the shape of a logo or other pattern). The continuous extruded element extending longitudinally of the rod may be of diameter (for a circle) or width at narrowest point (for other shape) of about 0.05 mm or greater, for example of diameter (for a circle) or width at narrowest point (for other shape) of from around 0.5 to around 10 mm. In one example, the continuous extruded element extending longitudinally of the rod may be of diameter (for a circle) or width at narrowest point (for other shape) of from around 0.5 to around 1.5 mm. In another example, the continuous extruded element extending longitudinally of the rod may be of diameter (for a circle) or width at narrowest point (for other shape) of from around 0.5 to around 10 mm; such larger continuous extruded elements may advantageously facilitate a reduction in weight or cost of the other filter components. The invention is preferably applicable to filter elements if the continuous extruded element extending longitudinally of the rod is of hollow cross-section.

In another aspect of the invention, there is provided a tobacco smoke filter or filter element comprising: a rod (for example a substantially cylindrical rod) of a tobacco smoke filtering material; and a continuous extruded element extending longitudinally of the rod (for example extending longitudinally through the rod, extending along the rod), wherein the continuous extruded element extending longitudinally of the rod is of solid cross-section. The continuous extruded element extending longitudinally of the rod may be of a solid cross-section which is, for example, circular, star shaped, trilobal, pentagonal, cog-shaped, or of a solid cross-section in the shape of a logo or other pattern. The continuous extruded element extending longitudinally of the rod may be of diameter (for a circle) or width at narrowest point (for other shape) of about 0.05 mm or greater, for example of diameter (for a circle) or width at narrowest point (for other shape) of from around 0.5 to around 10 mm. In one example, the continuous extruded element extending longitudinally of the rod may be of diameter (for a circle) or width at narrowest point (for other shape) of from around 0.5 to around 1.5 mm. In another example, the continuous extruded element extending longitudinally of the rod may be of diameter (for a circle) or width at narrowest point (for other shape) of from around 0.5 to around 10 mm; such larger continuous extruded elements may advantageously facilitate a reduction in weight or cost of the other filter components. The shape and dimensions of the solid cross-section may be determined by the extruder die. The tobacco smoke filter may be of length between 10 and 40 mm, e.g. between 15 and 35 mm, e.g. between 20 and 30 mm. The tobacco smoke filter element may be of length between 6 and 20 mm, e.g. between 10 and 19 mm, e.g. between 14 and 18 mm. The tobacco smoke filter or filter element may be of circumference between 16 and 38 mm, for example between 16 and 28 mm, for example between 20 and 26 mm. The tobacco smoke filter or filter element may further comprise a flavouring agent applied, for example, to the continuous extruded element. The flavouring agent may be any flavouring agent known or suitable for use in a smoking article such as a cigarette, for example menthol, spearmint etc. A preferred flavouring agent is menthol.

Herein, the term "continuous extruded element extending longitudinally of the rod" means a single element formed by extrusion. It does not include, for example, threads or strands or filaments or filament material formed from extruded materials. It does not include, for example, threads or strands or filaments or filament material woven from multiple filaments or fibres of extruded materials. Thus, the term does not include a thread such as a cellulose acetate thread which is formed from substantially uncrimped cellulose acetate filaments.

The extruded element of the invention may be provided in a variety of cross-sectional shapes, thereby providing a much greater distinctive end appearance for anti-counterfeit measures. Pigments may be included in the thread—these can be chosen from those with appropriate regulatory approvals and, in addition, may not potentially bleed out during use.

The continuous extruded element extending longitudinally of the rod may comprise a thermoplastic polymer, for example, cellulose acetate, polyethylene, polypropylene, polylactic acid, polyester or mixture thereof. Preferably, the continuous extruded element extending longitudinally of the rod comprises cellulose acetate. Methods of preparing extrusion grade cellulose acetate powder are known (e.g. see U.S. Pat. No. 4,228,246). Extrusion-grade cellulose ester pellets are commercially available from Rotuba Extruders of Linden, N.J. under the trade mark "Naturacell". The extrusion-grade cellulose ester pellets are converted into an extruded element for use according to the invention. The continuous extruded element extending longitudinally of the rod (for example comprising an extruded thermoplastic polymer e.g. extruded cellulose acetate) may further comprise a plasticiser (e.g. triacetin). The amount of plasticiser in the continuous extruded element may be from 7 to 42% by weight of the continuous extruded element, for example from 15.1 to 35% by weight of the continuous extruded element. It is known to use plasticiser (e.g. triacetin) with a filtering material (e.g. cellulose acetate tow) as set out below. However, the amount of plasticiser used with a filtering material is generally limited to 4-15% by weight filtering material or less, because a larger amount of plasticiser than this results in an undesirably hard filtering material and/or defects (e.g. holes) in the filtering material. The applicants have surprisingly found that the use of plasticiser with an extruded thermoplastic polymer (e.g. extruded cellulose acetate) enhances the flexibility of the extruded element, and that the flexibility increases with increased plasticiser content. Thus, the applicants have found that a surprisingly high amount of plasticiser (up to 42%, for example from 7 to 42%, for example 15.1 to 35% by weight of the continuous extruded element) provides enhanced flexibility, which is advantageous in the manufacturing process.

The filter or filter element may include one or more continuous extruded elements extending longitudinally of the rod. The continuous extruded elements may be the same, or different. If more than one continuous extruded element is present they are preferably aligned in a symmetrical pattern. The use of more than one continuous extruded element may provide a more distinctive end appearance and/or may provide increased capacity for loading of flavour agent. Further the provision of more than one continuous extruded element may advantageously facilitate a reduction in weight or cost of the other filter components.

In an example, the continuous extruded element or elements is a heavyweight extruded element. The inclusion of one or more heavyweight extruded threads in the filter may be advantageous where there are economic benefits in having a higher filter weight (e.g. due to duty thresholds, etc).

Preferably the, or each, continuous extruded element extending longitudinally of the rod is aligned substantially parallel to the longitudinal axis of the rod. The continuous extruded element could be of constant cross-section along its length, or of variable cross-section along its length.

The continuous extruded element extending longitudinally of the rod may be coloured or tinted using appropriate pigments, preferably those with regulatory approval for use in food contact applications. In an example of the invention the continuous extruded element extending longitudinally of the rod comprises a thermoplastic polymer (e.g. cellulose acetate) and a pigment (e.g. coloured or tinted pigment). The pigment is preferably one with regulatory approval for use in food contact applications. The pigment may preferably be any colour which contrasts with the (e.g. white) tobacco smoke filtering material, for example green, blue, red, orange etc. A coloured element (or coloured elements if more than one is present) may provide a distinctive end appearance that is useful for anti-counterfeit purposes.

The use of a continuous extruded element or elements of distinctive shape (of either solid or hollow cross-section) and/or colour may provide a filter or filter element which, when cut in a direction perpendicular to the longitudinal axis of the rod (during manufacture of the filter or filter cigarette), provides at the mouth end of the filter (or cigarette), a distinctive end appearance. This is useful as an anti-counterfeit measure. Further, the continuously extruded element according to the invention may be more resistant to distortion or flattening during the cutting process, and may therefore reduce or eliminate the "bleeding out" effect, and resulting unsatisfactory end appearance, associated with larger "thread" type filters, multitudinous filaments etc.

Thus, it can be seen that the extruded element(s) of the invention may be provided in a variety of cross-sectional shapes, sizes, colours, and (if more than one element is present) numbers and distribution patterns, thereby providing a much greater distinctive end appearance for anti-counterfeit measures. The distinctive shapes, sizes, colours, numbers, distribution patterns etc. of the continuous extruded element(s) may serve as a "visual cue", signifier or badge of origin—for example denoting a genuine product for anti-counterfeit purposes (whether or not flavour is included).

The tobacco smoke filtering material [e.g. included in, for example, forming, the rod (for example substantially cylindrical rod)] may be for example any of those materials (usually filamentary, fibrous, web or extruded) conventionally employed for tobacco smoke filter manufacture. The filtering material may be natural or synthetic filamentary tow, e.g. of cotton or plastics such as polyethylene or polypropylene, or cellulose acetate filamentary tow. It may be, for example, natural or synthetic staple fibres, cotton wool, web material such as paper (usually creped) and synthetic non-wovens, and extruded material (e.g. starch, synthetic foams). The tobacco smoke filtering material (e.g. cellulose acetate filamentary tow) may further comprise a plasticiser (e.g. triacetin). The amount of plasticiser may be from 4 to 15% by weight of the filtering material. The tobacco smoke filtering material may be over wrapped with a wrapper, for example a wrapper of paper, for example a wrapper of an air-permeable paper.

A filter according to the invention may be used on its own e.g. as a single segment filter. Such filters are well known in the art. A filter element according to the invention may be used as a segment, for example the mouth end segment, of a multi-segment filter, e.g. a dual, triple, other multiple filter. A filter element according to the invention may be used as another e.g. upstream segment, of a multi-segment filter—for example the tobacco end segment, middle segment etc. of a multi-segment filter, e.g. a dual, triple, other multiple filter. Multisegment filters are well known in the art.

In a filter cigarette according to the invention, a filter of the invention (or a filter which includes a filter element of the invention) is joined to a wrapped tobacco rod with one end towards the tobacco. The filter may, for example, be joined to the wrapped tobacco rod by ring tipping (which engages around just the adjacent ends of a [wrapped] filter and rod to leave much of the filter wrapper exposed) or by a full tipping overwrap (which engages around the full filter length and adjacent end of the tobacco rod). Any filter or filter cigarette according to the invention may be unventilated, or may be ventilated by methods well known in the art, e.g. by use of a pre-perforated or air-permeable plugwrap, and/or laser perforation of plugwrap and tipping overwrap.

The present invention also provides a filter cigarette which includes a tobacco smoke filter or filter element of the invention, as disclosed above.

The filters or filter elements according to the invention may be made as continuous rods, as is well known in the art. The continuous rod as it issues continuously from the production machine outlet is cut into finite lengths for subsequent use. This cutting may be into individual filters or filter elements as defined and described above, each of which is then attached to an individual wrapped tobacco rod to form a filter cigarette. More usually, however the continuously issuing rod is first cut into double or higher multiple (usually quadruple or sextuple) lengths for subsequent use; when the initial cut is into quadruple or higher lengths, then the latter are subsequently cut into double lengths for the filter cigarette assembly—in which the double length filter rod is assembled and joined (by ring tipping or full tipping overwrap) between a pair of wrapped tobacco rods with the combination then being severed centrally to give two individual filter cigarettes. It is this final severing which, in examples of cigarettes including filters or filter elements of the invention, reveals the end of the distinctively coloured and/or shaped extruded element.

The invention includes (e.g. double and higher) multiple length filter rods (and/or filter element rods), including a plurality of filter rods (filter element rods), e.g. joined end to end.

Figure 3:
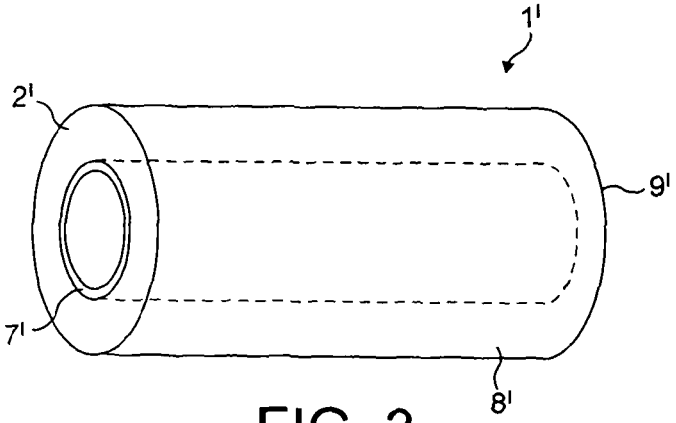
Figure 2:
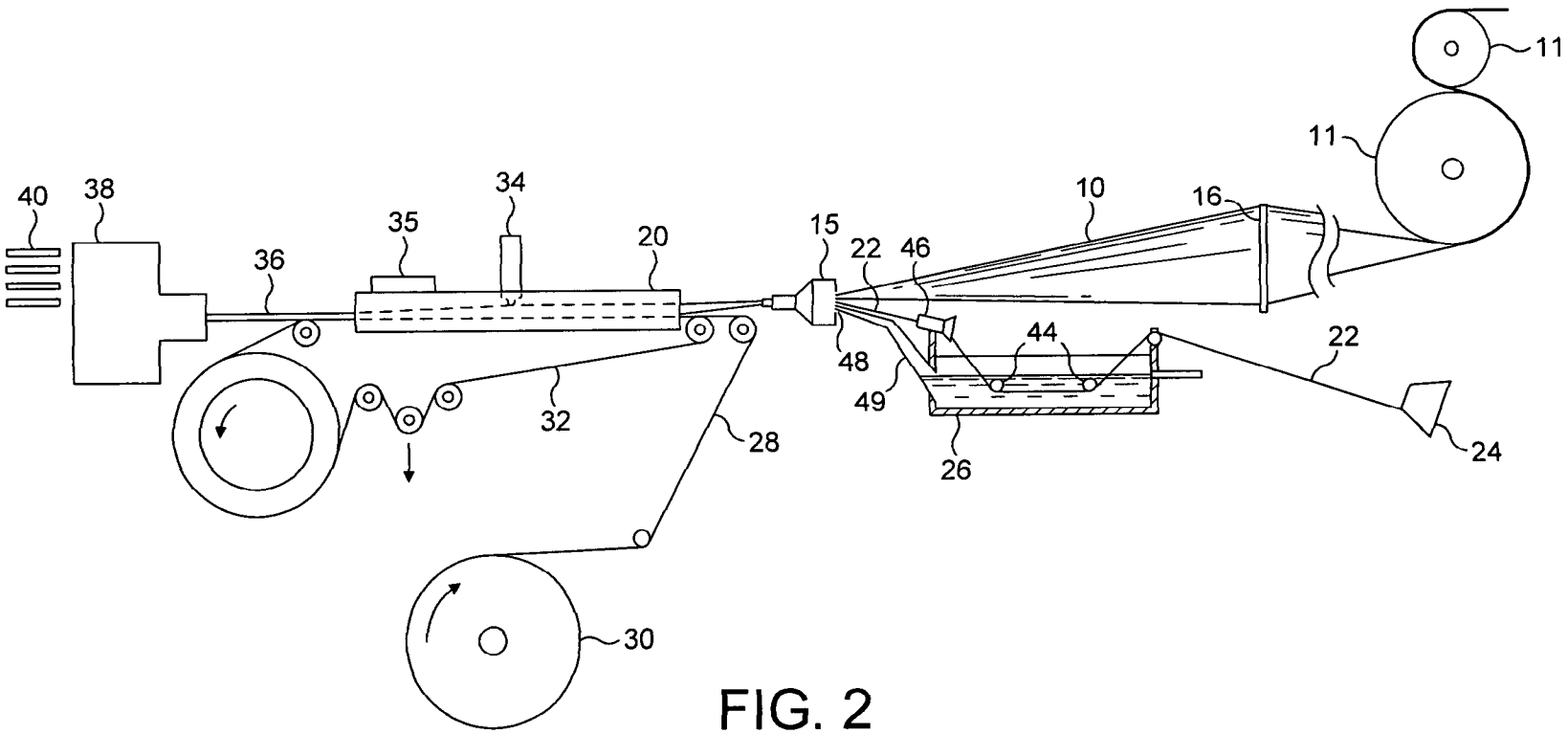

The present invention will now be illustrated with reference to the attached drawings in which:

FIG. 1 is a perspective, part cut away, view of a tobacco smoke filter according to an aspect of the invention;

FIG. 2 is a schematic side elevation view of an example of an apparatus for forming the filter of FIG. 1; and FIG. 3 is a perspective, part cut away, view of a tobacco smoke filter according to another embodiment of the invention FIG. 1 is a perspective, part cut away, view of a filter 1. Filter 1 includes a substantially cylindrical rod 2 of tobacco smoke filtering material in the form of a cylindrical cellulose acetate plug of length 27 mm and circumference of around 25 mm. The substantially cylindrical rod 2 is made from cellulose acetate tow which has been gathered and condensed into rod form by methods which are well known in the art (see e.g. below). Filter 1 includes a continuous extruded element 7 extending longitudinally through rod 2, formed from extruded cellulose acetate. The continuous extruded element 7 also includes a green pigment, but it will be appreciated that other pigments (blue, red etc.) may be used, or the continuous extruded element 7 may be white. The continuous extruded element 7 is of solid, circular, cross-section, and extends through the body of the rod 2 from one end of the filter to the other, thus presenting a green circle at each end of rod 2, which contrasts with the white colour of the cellulose acetate tow which has been gathered and condensed into rod form. The continuous extruded element 7 has, applied thereon, menthol. The menthol may be applied e.g. by the methods discussed in U.S. Pat. No. 4,281,671. Methods of preparing extrusion grade cellulose acetate powder are known (e.g. see U.S. Pat. No. 4,228,246). Extrusion-grade cellulose ester pellets are commercially available from Rotuba Extruders of Linden, N.J. under the trade mark "Naturacell". The extrusion-grade cellulose ester pellets are converted into an extruded element, and pigmented, by methods well known in the art. Filter 1 includes a paper wrapper 8 surrounding longitudinally extending core 2 which may be perforated (not shown) or air-permeable to provide a ventilated filter.

It will be appreciated that the filter of FIG. 1 may be joined at its upstream end 9 to a wrapped tobacco rod (not shown) by means of, for example, a full tipping overwrap which surrounds and engages the full length of the filter 1 and the adjacent end only of the wrapped tobacco rod, to form a filter cigarette. The filter of FIG. 1 may also be attached to a tobacco rod to form a filter cigarette by other means known in the art, such as ring tipping.

FIG. 2 shows a schematic side elevation view of an apparatus for forming filters of the invention, for example according to FIG. 1. The apparatus is well known in the art. A band of cellulose acetate tow 10 is drawn over an upwardly convex bowed bar 16 upstream of a ring or funnel 15. The bar 16 shapes the tow 10 reaching funnel 15 into a downwardly concave arch into which is positioned an extruded element guide mandrel 48. The tow passes through funnel 15, which has an internal wall converging downstream, and is further gathered and condensed into rod form as it enters and passes through the conventional rod making and wrapping garniture 20. A continuous extruded element 22 of (optionally pigmented e.g. green) extruded cellulose acetate is drawn continuously from a reel 24 (optionally, if flavour is desired, through a flavouring agent, e.g. menthol, applicator 26). Methods of preparing extrusion grade cellulose acetate powder are known (e.g. see U.S. Pat. No. 4,228,246). Extrusion-grade cellulose ester pellets are commercially available from Rotuba Extruders of Linden, N.J. under the trade mark "Naturacell". The extrusion-grade cellulose ester pellets are converted into an extruded element, and e.g. pigmented, by methods well known in the art. The prepared extruded element is then stored on a reel (e.g. reel 24) for later use. The extruded element 22 is drawn from reel 24, optionally flavoured, and led directly into engagement with the tow by means of the extruded element guide mandrel 48 at a region just upstream of funnel or ring 15, and travels with the tow to and through the garniture 20, to become incorporated in and extend the length of the rod produced. On start up of the apparatus, the tow is threaded through the machine into the garniture 20, and the free end of extruded element 22 is stuck to the tow upstream of funnel or ring 15; once the apparatus has been started, the advancing tow continuously entrains the extruded element 22 and draws it continuously from reel 24 via guide mandrel 48. Wrapping paper 28 is drawn continuously from reel 30 and fed continuously into the garniture 20, the paper 28 and the tow incorporating the thread 22 being carried continuously through the garniture by endless conveyor belt 32. In the garniture 20, the tow is shaped to rod form, and the paper 28 is wrapped around and secured with a lapped and stuck seam; member 34 applies a line of adhesive to one edge of paper 28, before the overlapping edges are bought into engagement. The continuously produced wrapped rod 36 passes to a cutter 38 which severs the rod 36 into individual lengths 40 each of which include a continuous extruded element of cellulose acetate. The lengths 40 may be single filter or filter elements, but, more usually, will be multiple double or higher multiple (usually quadruple or sextuple) lengths for subsequent use, as is well known. The above apparatus is well known and discussed in, for example, U.S. Pat. No. 4,281,671.

It will be appreciated that in an alternative to the embodiment shown the extruded element may be drawn directly from an extruder. In other words, the extruded element may be produced (by extrusion) on site simultaneously and in-line with rod production, rather than being pre-produced and stored on a reel, and drawn from the reel as and when needed.

FIG. 3 is a perspective, part cut away, view of a filter element 1'. Filter element 1' includes a substantially cylindrical rod 2' of tobacco smoke filtering material in the form of a cylindrical cellulose acetate plug of length 18 mm and circumference of around 25 mm. The substantially cylindrical rod 2' is made from cellulose acetate tow which has been gathered and condensed into rod form by methods which are well known in the art (see above). Filter element 1' includes a continuous extruded element 7' extending longitudinally through rod 2', formed from extruded cellulose acetate. The continuous extruded element 7' also includes a green pigment, but it will be appreciated that other pigments (blue, red etc.) may be used, or the continuous extruded element 7' may be white. The continuous extruded element 7' is of hollow, circular, cross-section, that is, is a hollow tube (a hollow tubular element of circular cross section), and extends through the body of the rod 2' from one end of the filter element to the other, thus presenting a green ring at each end of rod 2', which contrasts with the white colour of the cellulose acetate tow which has been gathered and condensed into rod form. The continuous extruded element 7' has, applied thereon, menthol. The menthol may be applied e.g. by the methods discussed in U.S. Pat. No. 4,281,671. Methods of preparing extrusion grade cellulose acetate powder are known (e.g. see U.S. Pat. No. 4,228,246). Extrusion-grade cellulose ester pellets are commercially available from Rotuba Extruders of Linden, N.J. under the trade mark "Naturacell". The extrusion-grade cellulose ester pellets are converted into an extruded element, and pigmented, by methods well known in the art. Filter element 1' includes a paper wrapper 8' surrounding longitudinally extending core 2' which may be perforated (not shown) or air-permeable to provide a ventilated filter. In a further example (not shown) the continuous extruded element 7" is of hollow, star shaped, cross-section, that is, is a hollow tube (a hollow tubular element of star shaped cross section), and extends through the body of the rod 2" from one end of the filter element to the other, thus presenting the green outline of a star at each end of rod 2", which contrasts with the white colour of the cellulose acetate tow which has been gathered and condensed into rod form.

It will be appreciated that the filter element 1' of FIG. 3 may be joined at its upstream end 9' to another segment of a multi segment filter.

It will be appreciated that filters and filter elements of this example of the invention may be made by methods other than those described above. For example, the filter or filter elements of the invention may be made using devices and/or processes which introduce the continuous extruded element (e.g. of cellulose acetate) or elements in a precise location or locations in or across the cross sectional area of the filter body, or on the surface of the filter body.

It will be appreciated by the skilled man that filters or filter elements of other examples of the invention may be made by methods which are well known in the art.

The invention claimed is:

1. A tobacco smoke filter or filter element comprising: a rod of a tobacco smoke filtering material; a continuous extruded element extending longitudinally of the rod; and a flavouring agent, wherein the continuous extruded element extending longitudinally of the rod further comprises a pigment of a contrasting colour to the tobacco smoke filtering material, wherein the continuous extruded element extending longitudinally of the rod is of diameter, or width at narrowest point, of from about 0.5 to about 10 mm, and the continuous extruded element extending longitudinally of the rod has a solid cross-section along a full length thereof and is visible at a mouth end of the filter or filter element.

* * * * *